US007053768B2

(12) United States Patent
Seshadri

(10) Patent No.: US 7,053,768 B2
(45) Date of Patent: May 30, 2006

(54) DETECTING COMMUNICATIONS DISCONNECT AND ENABLING WIRELESS EMERGENCY CALL

(75) Inventor: Nambi Seshadri, Irvine, CA (US)

(73) Assignee: Broadcom Corporation, Irvine, CA (US)

( * ) Notice: Subject to any disclaimer, the term of this patent is extended or adjusted under 35 U.S.C. 154(b) by 236 days.

(21) Appl. No.: 10/660,792

(22) Filed: Sep. 12, 2003

(65) Prior Publication Data

US 2004/0124976 A1 Jul. 1, 2004

Related U.S. Application Data

(60) Provisional application No. 60/409,933, filed on Sep. 12, 2002, provisional application No. 60/445,827, filed on Feb. 10, 2003.

(51) Int. Cl.
*G08B 1/00* (2006.01)

(52) U.S. Cl. ..... 340/531; 340/506

(58) Field of Classification Search ..... 340/331, 340/531, 539.26, 529, 506, 527, 540; 379/45, 379/37, 2, 32.06, 33; 455/424
See application file for complete search history.

(56) References Cited

U.S. PATENT DOCUMENTS 5,745,849 A * 4/1998 Britton ..... 455/404.1
5,751,789 A * 5/1998 Farris et al. ..... 379/32.04
5,983,114 A * 11/1999 Yao et al. ..... 455/509
6,104,785 A * 8/2000 Chen ..... 379/49
6,169,895 B1 * 1/2001 Buhrmann et al. ..... 455/423
6,204,760 B1 * 3/2001 Brunius ..... 340/529
6,411,802 B1 * 6/2002 Cardina et al. ..... 455/424
6,442,241 B1 * 8/2002 Tsumpes ..... 379/45

OTHER PUBLICATIONS

"IEEE 802.11, A Technical Overview," Pablo Brenner, BreezeNet website, Jul. 8, 1997, www.sss-mag.com/pdf/80211p.pdf.
Donny Jackson, Telephony, Ultrawideband May Thwart 802.11, Bluetooth Efforts, PRIMEDIA Business Magazines & Media Inc., Feb. 11, 2002.
Daniel L. Lough, et al., "A Short Tutorial on Wireless LANs and IEEE 802.11," The IEEE Computer Society's Student Newsletter, Virginia Polytechnic Institute and State University, Summer 1997, vol. 5, No. 2.
Dr. Robert J. Fontana, "A Brief History of UWB Communications," Multispectral.com, Multispectral Solutions, Inc., www.multispectral.com/history.html, Aug. 20, 2002.

(Continued)

*Primary Examiner*—Anh V. La
(74) *Attorney, Agent, or Firm*—Squire, Sanders & Dempsey L.L.P.

(57) ABSTRACT

A process of detecting and communicating alarm events by a security system is disclosed. Sensors in communication with the security system are monitored, where specific changes in outputs of the sensors indicate an alarm event. It is determined whether a landline communication medium connecting the security system with a monitoring headquarters is active, when the alarm event is detected. Data, indicating the alarm event, is sent over the landline communication medium to the monitoring headquarters when the landline communication medium is determined to be active. Also, data, indicating the alarm event, is sent over a wireless communication medium to the monitoring headquarters when the landline communication medium is not determined to be active.

30 Claims, 4 Drawing Sheets

OTHER PUBLICATIONS

Gerald F. Ross, "Early Motivations and History of Ultra Wideband Technology," Anro Engineering, Inc., Multispectral.com, Multispectral Solutions, Inc., www.multispectral.com/history.html, Aug. 20, 2002.
Dr. Terence W. Barrett, "History of Ultra Wideband (UWB) Radar & Communications: Pioneers and Innovators, " Proceedings and Progress in Electromagnetics Symposium 2000 (PIERS2000), Cambridge, MA, Jul. 2000.
Dr. Henning, F. Harmuth, "An Early History of Nonsinusoidal Electromagnetic Technologies," Multispectral.com, Multispectral Solutions, Inc., www.multispectral.com/history.html, Aug. 20, 2002.
Rebecca Taylor, "Hello, 802.11b AND Bluetooth: Let's Not Be Stupid!", ImpartTech.com, www.ImportTech.com/802.11-bluetooth.htm, Aug. 21, 2002.
Matthew Peretz, "802.11, Bluetooth Will Co-Exist: Study," 802.11-Planet.com, INT Media Group, Inc., Oct. 30, 2001.
"Bluetooth and 802.11: A Tale of Two Technologies," 10Meters.com, www.10meters.com/blue_802.html, Dec. 2, 2000.
Keith Shaw, "Bluetooth and Wi-Fi: Friends or foes?", Network World Mobile Newsletter, Network World, Inc., Jun. 18, 2001.
Joel Conover, "Anatomy of IEEE 802.11b Wireless," NetworkComputing.com, Aug. 7, 2000.
Bob Brewin, "Intel, IBM Push for Public Wireless LAN," Computerworld.com, Computerworld Inc., Jul. 22, 2002.
Ernest Khoo, "A CNET tutorial: What is GPRS?", CNETAsia, CNET Networks, Inc., Feb. 7, 2002.
Les Freed, "Et Tu, Bluetooth?", ExtremeTech.com, Ziff Davis Media Inc., Jun. 25, 2001.
Bluetooth & 802.11b—Part 1, www.wilcoxonwireless.com/whitepapers/bluetoothvs802.doc, Jan. 2002.
Bob Brewin, "Report: IBM, Intel, Cell Companies Eye National Wi-Fi Net," Computerworld.com, Computerworld Inc., Jul. 16, 2002.
Bob Brewin, "Microsoft Plans Foray Into Home WLAN Device Market," Computerworld.com, Computerworld Inc., Jul. 22, 2002.
Bob Brewin, "Vendors Field New Wireless LAN Security Products," Computerworld.com, Computerworld Inc., Jul. 22, 2002.
Jeff Tyson, "How Wireless Networking Works," Howstuffworks.com, Howstuffworks, Inc., www.howstuffworks.com/wireless-network.htm/printable, Aug. 15, 2002.
Curt Franklin, "How Bluetooth Works," Howstuffworks.com, Howstuffworks, Inc., www.howstuffworks.com/bluetooth.htm/printable, Aug. 15, 2002.
802.11b Networking News, News for Aug. 19, 2002 through Aug. 11, 2002, 80211b.weblogger.com/, Aug. 11-19, 2002.
"Wireless Ethernet Networking with 802.11b, An Overview," HomeNetHelp.com, Anomaly, Inc., www.homenethelp.com/80211.b/index.asp, Aug. 20, 2002.
"Simple 802.11b Wireless Ethernet Network with an Access Point," HomeNetHelp.com, Anomaly, Inc., www.homenethelp.com/web/diagram/access-point.asp, Aug. 20, 2002.
"Simple 802.11b Wireless Ethernet Network without an Access Point," HomeNetHelp.com, Anomaly, Inc., www.homenethelp.com/web/diagram/ad-hoc.asp, Aug. 20, 2002.
"Cable/DSL Router with Wired and Wireless Ethernet Built In," HomeNetHelp.com, Anomaly, Inc., www.homenethelp.com/web.diagram/share-router-wireless.asp, Aug. 20, 2002.
"Bridging a Wireless 802.11b Network with a Wired Ethernet Network" HomeNetHelp.com, Anomaly, Inc., www.homenethelp.com/web/diagram/wireless-bridged.asp, Aug. 20, 2002.
"Wireless Access Point (802.11b) of the Router Variety," HomeNetHelp.com, Anomaly, Inc., www.homenethelp.com/web/diagram/share-wireless-ap.asp, Aug. 20, 2002.
Robert Poe, "Super-Max-Extra-Ultra-Wideband!", Business2.com, Oct. 10, 2000.
David G. Leeper, "Wireless Data Blaster," ScientificAmerican.com, Scientific American, Inc., May 4, 2002.
Steven J. Vaughan-Nichols, "Ultrawideband Wants to Rule Wireless Networking," TechUpdate.ZDNet.com, Oct. 30, 2001.
Jim Zyren and Al Petrick, "Brief Tutorial on IEEE 802.11 Wireless LANs," AN9829, Intersil Corporation, Feb. 1999.
"Overview of UWB?", PulseLink.net, Pulse~LINK, Inc., www.pulselink.net/ov_history.html, Sep. 4, 2002.
Robert X. Cringely, "The 100 Mile-Per-Gallon Carburetor—How Ultra Wide Band May (or May Not) Change the World," Interesting-People.org, Jan. 26, 2002.
William A. Kissick, Editor, "The Temporal and Spectral Characteristics of Ultrawideband Signals," NTIA Report 01-383, Jan. 2001, www.its.bldrdoc.gov/pub/ntia-rpt/01-383/.
"Ultra Wide Band," www.ida.gov.sg/Website/IDAContent.nsf/dd1521fle79ecf3bc825682f0045a349/1856626048baf-403c82569880267e26%3FOpenDocument+%22Full+duplex+UWB+handheldtransceiver%22&hl=en&ie=UTF-8, Aug. 20, 2002.

* cited by examiner

DETECTING COMMUNICATIONS DISCONNECT AND ENABLING WIRELESS EMERGENCY CALL

CROSS REFERENCE TO RELATED APPLICATIONS

This application claims priority of U.S. Provisional Patent Application Ser. No. 60/409,933, filed Sep. 12, 2002 and 60/445,827, filed Feb. 10, 2003, entitled Detecting Communications Disconnect and Enabling Wireless Emergency Call. The contents of the provisional applications are hereby incorporated by reference.

BACKGROUND OF THE INVENTION

1. Field of Invention

The present invention is directed to methods and systems for use in security systems in securing the premises of establishments. The methods and systems are equally applicable to both business and household security systems.

More specifically, the present invention is directed to methods and systems that allow for a system to detect when a communication medium is disrupted and use an alternate communication medium to contact a reporting center, when some triggering event occurs.

2. Description of Related Art

In home and other types of security systems, a network of sensors is used to secure the premises of a property. The security system maintains contact with various sensors used and detects and reports changes in those sensors. In the case of home security systems, sensors are placed at access points, such as doors and windows, and the system monitors those sensors to determine when access points are opened or closed. Sensors can also be used to sense other states, such as fire detection by a smoke or heat detector and area sensors that detect the heat or presence of unauthorized persons. When the system is armed, the system reports an alarm event when a predetermined change in any of the sensors occurs. Security systems may also have a "panic" button that will cause an alarm event to be reported even though no sensor has changed its state.

The reporting by the system usually occurs through a landline telephone line to a monitoring headquarters providing the monitoring services. Some business systems use dedicated lines that do not rely on telephone service, but a majority of the systems rely on telephone lines. A potential point of failure occurs when a person trying to gain access to premises cuts the telephone or other lines before gaining access to the premises. In that case, since there is no way for the system to report the alarm event to the monitoring headquarters, someone may gain access without worrying about interference of others contacted by the monitoring headquarters in the case of an alarm event.

It is also possible for the monitoring headquarters to periodically poll security systems to make sure that reporting can occur when needed, but this would tie up system resources of the monitoring headquarters and also preclude the landlines from other uses while such polling is occurring. Additionally, landlines are subject to corrosion or wear and tear and services can be cut off even when there is no problem with the security system. Also, locations that do not have a landline access cannot be monitored, and other access control security systems without monitoring would need to be employed.

Therefore, there is a need for method and apparatus to provide an alternate communication medium to contact a reporting center, when some event, for which the system is designed to detect, occurs. There is also a need for such an apparatus and method that can utilize the alternate communication medium when the ordinary communication medium becomes unavailable or unusable.

SUMMARY OF THE INVENTION

The present invention provides an efficient solution to the problems discussed above by utilizing a wireless connection to establish communication with a monitoring headquarters. Such a wireless connection could be the main reporting connection for systems that do not have landline access or can be used in case no landline connection can be established for reporting. In the latter case, for example, if someone were to cut the telephone lines to a residence, an alarm event could still be reported through a wireless connection, such as a cellular telephone network.

According to one aspect of this invention, a process of detecting and communicating alarm events by a security system is disclosed. Sensors in communication with the security system are monitored, where specific changes in outputs of the sensors indicate an alarm event. It is determined whether a landline communication medium connecting the security system with a monitoring headquarters is active, when the alarm event is detected. Data, indicating the alarm event, is sent over the landline communication medium to the monitoring headquarters when the landline communication medium is determined to be active. Also, data, indicating the alarm event, is sent over a wireless communication medium to the monitoring headquarters when the landline communication medium is not determined to be active.

Alternatively, the method can also include querying the sensors to determine baseline output states of the sensors. Also, the method can include establishing a wireless communication connection with the monitoring headquarters and sending the data through the wireless communication connection. Additionally, the data, indicating the alarm event, may be sent over a telephone line to the monitoring headquarters and the telephone line may be monitored to determine whether the line exhibits a dial tone. The sending of the alarm event data over the wireless communication medium can include sending the data through a satellite communications link with the monitoring headquarters, through a cellular telephone network to the monitoring headquarters, and through a wireless data service to the monitoring headquarters.

According to another embodiment of this invention, a process of detecting and communicating alarm events by a security system is disclosed. A landline communication medium, connecting the security system with a monitoring headquarters, is monitored to determine whether the landline communication medium is active. A default communication medium is switched from the landline communication medium to a wireless communication medium, when the landline communication medium is determined to not be active. Data, indicating an alarm event, is sent over the default communication medium to the monitoring headquarters when the alarm event is detected.

Alternatively, the process can include establishing a wireless communication connection with the monitoring headquarters and sending the data through the wireless communication connection, when the landline communication medium is determined to not be active. Also, the landline communication medium may be a telephone line to the monitoring headquarters and the telephone line may be determined to be active when the line exhibits a dial tone. In addition, the default communication medium may be a satellite communications link with the monitoring headquarters, a cellular telephone network connecting to the monitoring headquarters or a wireless data service connecting to the monitoring headquarters. Additionally, the default communication medium may be set to both the landline communication medium and the wireless communication medium, when both the landline communication medium and the wireless communication medium are active.

According to an alternate embodiment, a security system for detecting and communicating alarm events is disclosed. The security system includes monitoring means for monitoring sensors in communication with the security system, where specific changes in outputs of the sensors indicate an alarm event and determining means for determining whether a landline communication medium connecting the security system with a monitoring headquarters is active, when the alarm event is detected. The system further includes first sending means for sending data, indicating the alarm event, over the landline communication medium to the monitoring headquarters when the landline communication medium is determined to be active and second sending means for sending data, indicating the alarm event, over a wireless communication medium to the monitoring headquarters when the landline communication medium is not determined to be active.

The present invention is also directed to a security system for detecting and communicating alarm events. The security system includes monitoring means for monitoring a landline communication medium, connecting the security system with a monitoring headquarters, to determine whether the landline communication medium is active. The system also includes switching means for switching a default communication medium from the landline communication medium to a wireless communication medium, when the landline communication medium is determined to not be active and sending means for sending data, indicating an alarm event, over the default communication medium to the monitoring headquarters when the alarm event is detected.

According to one embodiment of the present invention, a security system for detecting and communicating alarm events is disclosed. The security system includes a monitor, for monitoring sensors in communication with the security system, where specific changes in outputs of the sensors indicate an alarm event and a determiner, for determining whether a landline communication medium connecting the security system with a monitoring headquarters is active, when the alarm event is detected. The system also includes a first transmitting unit, for sending data, indicating the alarm event, over the landline communication medium to the monitoring headquarters when the landline communication medium is determined to be active and a second transmitting unit, for sending data, indicating the alarm event, over a wireless communication medium to the monitoring headquarters when the landline communication medium is not determined to be active.

According to another embodiment, a security system for detecting and communicating alarm events is discussed. The security system includes a monitor, for monitoring a landline communication medium, connecting the security system with a monitoring headquarters, to determine whether the landline communication medium is active. The system also includes a switch, for switching a default communication medium from the landline communication medium to a wireless communication medium, when the landline communication medium is determined to not be active and a transmitting unit for sending data, indicating an alarm event, over the default communication medium to the monitoring headquarters when the alarm event is detected.

These and other objects of the present invention will be described in or be apparent from the following description of the preferred embodiments.

BRIEF DESCRIPTION OF THE DRAWINGS

For the present invention to be easily understood and readily practiced, preferred embodiments will now be described, for purposes of illustration and not limitation, in conjunction with the following figures.

DETAILED DESCRIPTION OF PREFERRED EMBODIMENTS

The present invention addresses the problems discussed above by utilizing a wireless connection to establish communication with a monitoring headquarters. Such a wireless connection could be the main reporting connection for systems that do not have landline access or can be used in case no landline connection can be established for reporting. In the latter case, for example, if someone were to cut the telephone lines to a residence, an alarm event could still be reported through a wireless connection, such as a cellular telephone network.

It is noted that while cellular wireless telephones and networks are discussed at length specifically herein, the present invention is not so limited. In some embodiments, other wireless forms of communication are utilized, such as satellite communication, Global System for Mobile Communications, Code Division Multiple Access, Time Division Multiple Access General, High Speed Circuit Switched Data, Packet Radio Service, homeRF, IEEE 802.11 and Local Multipoint Distribution Services.

Figure 1:
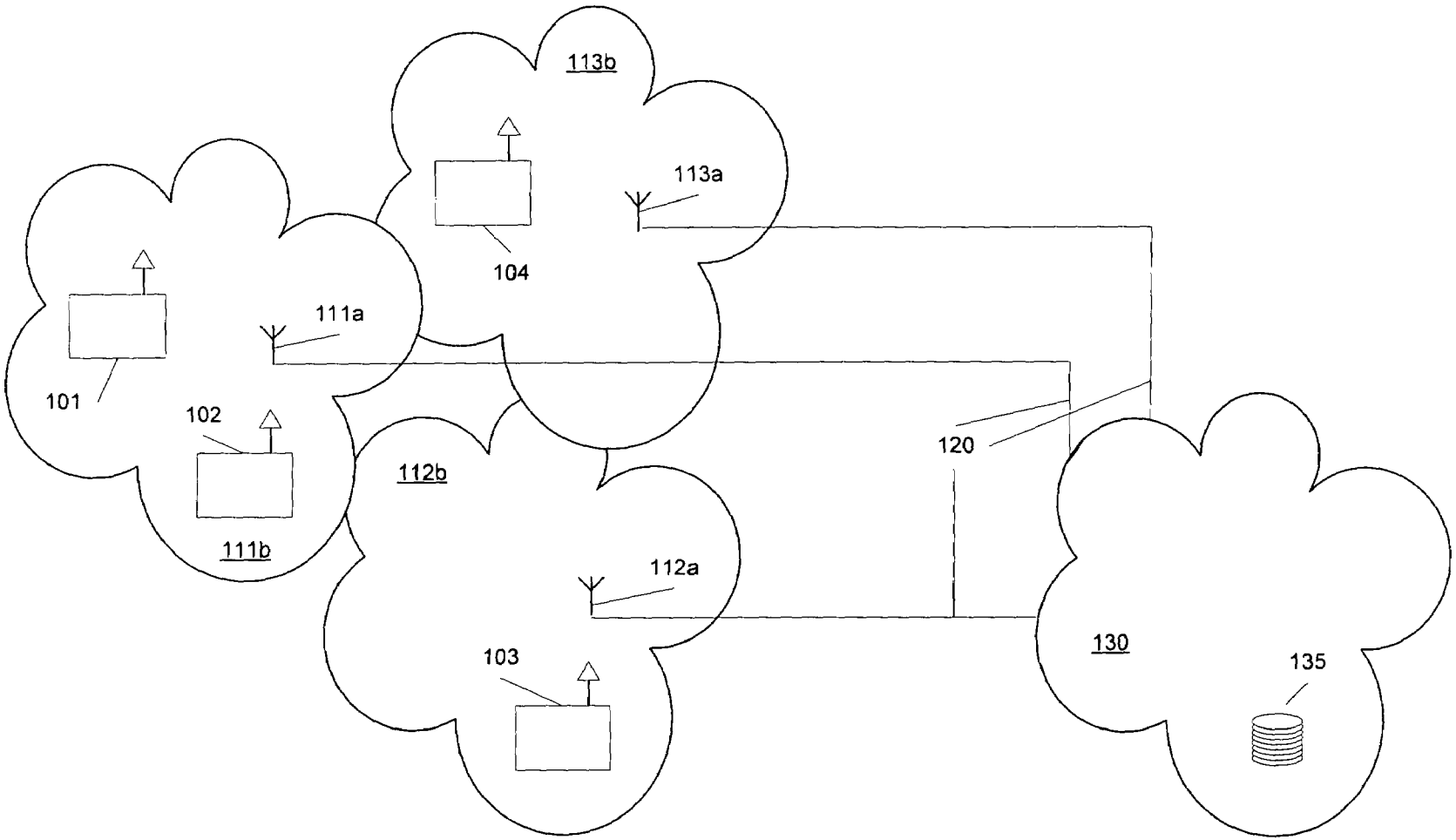
FIG. 1 illustrates a general wireless telephone network with multiple cells serving various wireless devices.

A general cellular telephone network is illustrated in FIG. 1. Multiple cells 111*b*, 112*b* and 113*b* are established through the use of antennas 111*a*, 112*a* and 113*a*. Devices 101–104 having access to the cellular telephone network are able to move from cell to cell and maintain access with the network. Each antenna 111*a*–113*a* has a connection 120 with a service provider 130. The service provider 130 controls access to the network, maintains records 135 about the use and the users of the network and coordinates the handing-off of access as the devices pass between the cells. The service provider identifies each device and routes communication to the proper location of the particular device. Commonly, the devices 101–104 may be cellular telephones, computers with wireless modems and other devices that exchange information with the service provider.

Figure 2:
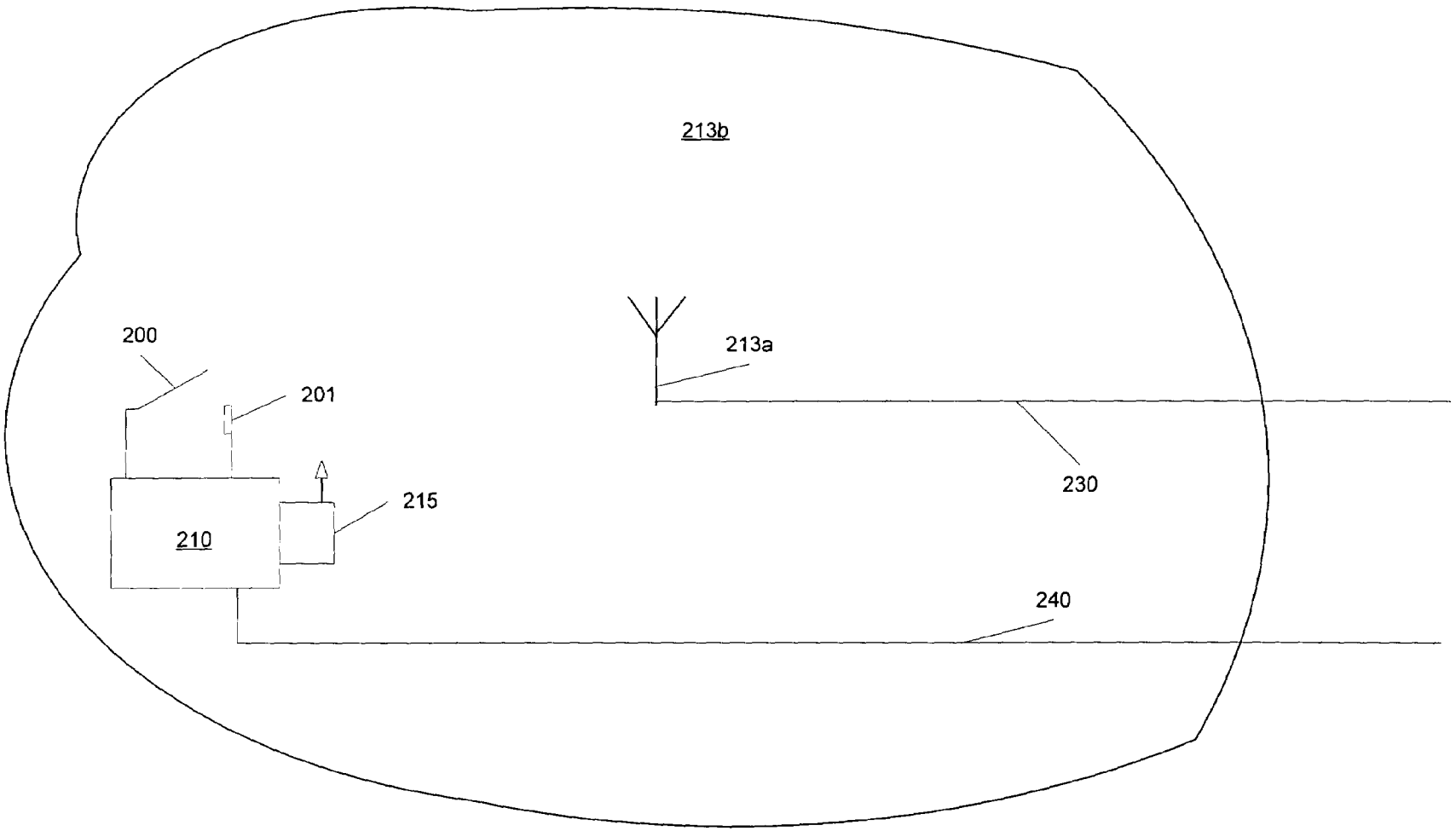
FIG. 2 illustrates a security system using a landline and/or a wireless telephone as its communication medium, according to one embodiment of the present invention.

FIG. 2 illustrates one embodiment of the present invention, utilizing a cellular telephone network. The cell 213*b* is established by the range of the antenna 213*a* which maintains communication with the service provider through the communication line 230. Within the cell 213*b*, a security system 210 provides security for an installation. By way of example, a door 200 is equipped with a sensor 201 that senses whether the door is in a closed or an opened state. The sensor 201 is in communication with the security system 210 and reports unauthorized access when the system is armed. The reporting of alarm events typically occur through a landline connection 240 to a monitoring headquarters.

The security system 210 can be equipped with a circuit or a software assisted detector to determine if the landline connection 240 is active and capable of sending and receiving communications thereon. When the landline connection 240 is not operational, the system 210 uses a device 215 that can access the cellular network established within the cell 213*b*. The communication line 230 is used to establish communication with the monitoring headquarters through the cellular network, with the monitoring headquarters notifying the predetermined individuals or authorities.

Figure 3:
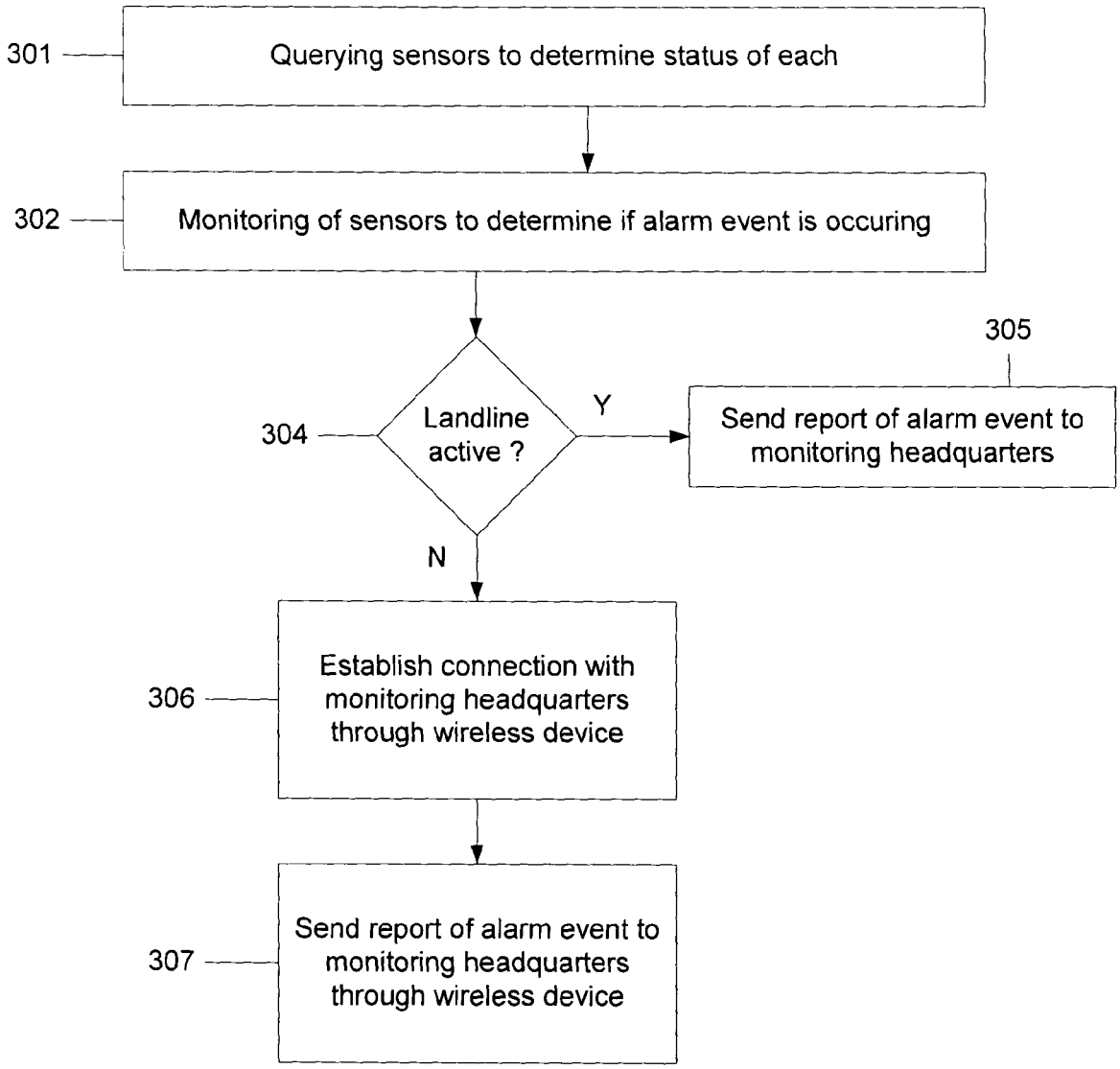
FIG. 3 illustrates a flow chart of the process of monitoring for alarm events in a security system, according to an embodiment of the present invention.

The process of the present invention, according to one embodiment, is illustrated in FIG. 3. In step 301, the security system queries the sensors to determine the status of each sensor, after which each sensor is monitored to determine if the status changes, i.e. if an alarm event is occurring, in step 302. Once an alarm event occurs, the security system determines whether the landline connection is active, in step 304, and sends the alarm event report over the landline to a monitoring headquarters, in step 305, when the landline connection is active. When the landline is not active, in step 304, the security system establishes a connection with the monitoring headquarters through the wireless device in step 306. The alarm event report is sent using the wireless device to the monitoring headquarters in step 307.

Figure 4:
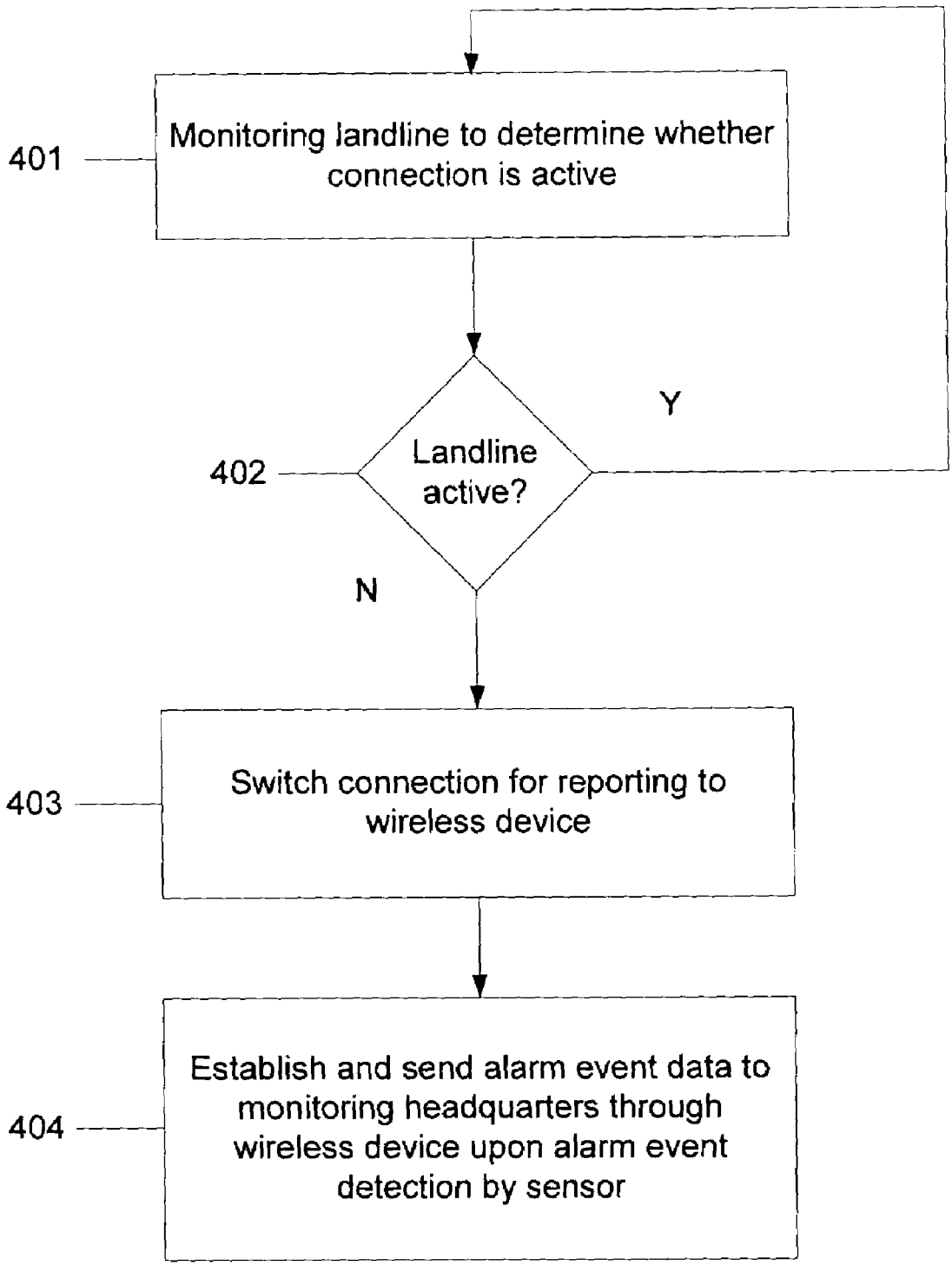
FIG. 4 illustrates a flow chart of the process of monitoring for alarm events in a security system, according to another embodiment of the present invention.

Additional embodiments of the invention may also allow for the security system 210 to switch from using the landline connection 240 to use of the wireless device 215 as its primary communication connection once a disruption in the landline occurs. In other words, the security system 210 may actively or periodically monitor the state of the landline, and immediately utilize the wireless device 215 once an alarm event occurs if the landline has already been determined to have been disrupted. This process is illustrated in FIG. 4, with the security system monitoring the landline connection, in steps 401 and 402, and switching the main connection method to the wireless device, in step 403, when the landline is determined to not be active. Alarm events are sent to the monitoring headquarters upon event alarm event detection, in step 404.

Additionally, the present embodiment is also applicable to security systems that do not have an established landline 240 and use the wireless device 215 as its sole communication connection. Such embodiments may be applicable to systems that lack a landline communication connection, or even lack an alternating current power source. The latter would be applicable to securing of a work shed or other container that does not have power or a communication medium connected thereto. In that case, the security system would alert a monitoring headquarters once a sensor is tripped through the wireless communication medium.

While the above examples use a cellular telephone network as the wireless communication medium, the present invention is not limited to cellular telephone networks. Additionally, the wireless communication device may be incorporated into the security system or added during or after the installation of the security system. Also, the present invention is also applicable to systems that utilize both landline and wireless communication media concurrently to report alarm events. This embodiment is also important in the case when the landline connection is engaged and a connection through that landline connection is not possible. Also, the present invention is applicable to all security systems that exchange data with a monitoring headquarters, regardless of the type of connection made or the type of data that is exchanged.

The above-discussed configuration of the invention is, in one embodiment, embodied on a semiconductor substrate, such as silicon, with appropriate semiconductor manufacturing techniques and based upon a circuit layout which would, based upon the embodiments discussed above, be apparent to those skilled in the art. A person of skill in the art with respect to semiconductor design and manufacturing would be able to implement the various modules, interfaces, and components, etc. of the present invention onto a single semiconductor substrate, based upon the architectural description discussed above. It would also be within the scope of the invention to implement the disclosed elements of the invention in discrete electronic components, thereby taking advantage of the functional aspects of the invention without maximizing the advantages through the use of a single semiconductor substrate. Additionally, the present invention can be implemented totally or partially through software.

Although the invention has been described based upon these preferred embodiments, it would be apparent to those of skilled in the art that certain modifications, variations, and alternative constructions would be apparent, while remaining within the spirit and scope of the invention. In order to determine the metes and bounds of the invention, therefore, reference should be made to the appended claims.

What is claimed is:

1. A process of detecting and communicating alarm events by a security system, said process comprising:

monitoring sensors in communication with the security system, where specific changes in outputs of the sensors indicate an alarm event;

determining whether a landline communication medium connecting the security system with a monitoring headquarters is active, when the alarm event is detected;

sending data, indicating the alarm event, over the landline communication medium to the monitoring headquarters when the landline communication medium is determined to be active; and sending data, indicating the alarm event, over a wireless communication medium to the monitoring headquarters when the landline communication medium is not determined to be active, wherein said step of sending data, indicating the alarm event, over a wireless communication medium comprises sending the data through a satellite communications link with the monitoring headquarters.

2. A process as recited in claim 1, further comprising querying the sensors to determine baseline output states of the sensors.

3. A process as recited in claim 1, wherein said step of sending data, indicating the alarm event, over a wireless communication medium comprises establishing a wireless communication connection with the monitoring headquarters and sending the data through the wireless communication connection.

4. A process as recited in claim 1, wherein the step of sending data, indicating the alarm event, over the landline communication medium comprises sending the data, indicating the alarm event, over a telephone line to the monitoring headquarters.

5. A process as recited in claim 4, wherein said step of determining whether a landline communication medium connecting the security system with a monitoring headquarters is active comprises detecting whether the telephone line will allow for a connection to be made to a telephone network.

6. A process of detecting and communicating alarm events by a security system, said process comprising:

monitoring a landline communication medium which connects the security system with a monitoring headquarters, to determine whether the landline communication medium is active;

switching a default communication medium from the landline communication medium to a wireless communication medium, when the landline communication medium is determined to not be active; and sending data, indicating an alarm event, over the default communication medium to the monitoring headquarters when the alarm event is detected, wherein said step of sending data, indicating the alarm event, over the default communication medium comprises sending the data through a satellite communications link with the monitoring headquarters, when the landline communication medium is determined to not be active.

7. A process as recited in claim 6, wherein said step of sending data, indicating the alarm event, over the default communication medium comprises establishing a wireless communication connection with the monitoring headquarters and sending the data through the wireless communication connection, when the landline communication medium is determined to not be active.

8. A process as recited in claim 6, wherein the step of sending data, indicating the alarm event, over the default communication medium comprises sending the data, indicating the alarm event, over a telephone line to the monitoring headquarters, when the landline communication medium is determined to be active.

9. A process as recited in claim 8, wherein said monitoring a landline communication medium, connecting the security system with a monitoring headquarters, to determine whether the landline communication medium is active comprises detecting whether the telephone line will allow for a connection to be made to a telephone network.

10. A process as recited in claim 6, further comprising setting the default communication medium to both the landline communication medium and the wireless communication medium, when both the landline communication medium and the wireless communication medium are active.

11. A security system for detecting and communicating alarm events, comprising:

monitoring means for monitoring sensors in communication with the security system, where specific changes in outputs of the sensors indicate an alarm event;

determining means for determining whether a landline communication medium connecting the security system with a monitoring headquarters is active, when the alarm event is detected;

first sending means for sending data, indicating the alarm event, over the landline communication medium to the monitoring headquarters when the landline communication medium is determined to be active; and second sending means for sending data, indicating the alarm event, over a wireless communication medium to the monitoring headquarters when the landline communication medium is not determined to be active, wherein said second sending means comprises third sending means for sending the data through a satellite communications link with the monitoring headquarters.

12. A security system as recited in claim 11, further comprising querying means for querying the sensors to determine baseline output states of the sensors.

13. A security system as recited in claim 11, wherein said second sending means comprises establishing means for establishing a wireless communication connection with the monitoring headquarters and third sending means for sending the data through the wireless communication connection.

14. A security system as recited in claim 11, wherein the first sending means comprises third sending means for sending the data, indicating the alarm event, over a telephone line to the monitoring headquarters.

15. A security system as recited in claim 14, wherein said determining means comprises detecting means for detecting whether the telephone line will allow for a connection to be made to a telephone network.

16. A security system for detecting and communicating alarm events, comprising:

monitoring means for monitoring a landline communication medium which connects the security system with a monitoring headquarters, to determine whether the landline communication medium is active;

switching means for switching a default communication medium from the landline communication medium to a wireless communication medium, when the landline communication medium is determined to not be active; and sending means for sending data, indicating an alarm event, over the default communication medium to the monitoring headquarters when the alarm event is detected, wherein said sending means comprises second sending means for sending the data through a satellite communications link with the monitoring headquarters.

17. A security system as recited in claim 16, wherein said sending means comprises establishing means for establishing a wireless communication connection with the monitoring headquarters and second sending means for sending the data through the wireless communication connection.

18. A security system as recited in claim 16, wherein said sending means comprises second sending means for sending the data, indicating the alarm event, over a telephone line to the monitoring headquarters.

19. A security system as recited in claim 18, wherein said monitoring means comprises detecting means for detecting whether the telephone line will allow for a connection to be made to a telephone network.

20. A security system as recited in claim 16, further comprising setting means for setting the default communication medium to both the landline communication medium and the wireless communication medium, when both the landline communication medium and the wireless communication medium are active.

21. A security system for detecting and communicating alarm events, comprising:

a monitor, for monitoring sensors in communication with the security system, where specific changes in outputs of the sensors indicate an alarm event;

a determiner, for determining whether a landline communication medium connecting the security system with a monitoring headquarters is active, when the alarm event is detected;

a first transmitting unit, for sending data, indicating the alarm event, over the landline communication medium to the monitoring headquarters when the landline communication medium is determined to be active; and a second transmitting unit, for sending data, indicating the alarm event, over a wireless communication medium to the monitoring headquarters when the landline communication medium is not determined to be active, wherein said second transmitting unit comprises a third transmitting unit for sending the data through a satellite communications link with the monitoring headquarters.

22. A security system as recited in claim 21, further comprising a poling unit for querying the sensors to determine baseline output states of the sensors.

23. A security system as recited in claim 21, wherein said second transmitting unit comprises a link establisher for establishing a wireless communication connection with the monitoring headquarters and a third transmitting unit for sending the data through the wireless communication connection.

24. A security system as recited in claim 21, wherein the first transmitting unit comprises a third transmitting unit for sending the data, indicating the alarm event, over a telephone line to the monitoring headquarters.

25. A security system as recited in claim 24, wherein said determiner comprises a detector for detecting whether the telephone line will allow for a connection to be made to a telephone network.

26. A security system for detecting and communicating alarm events, comprising:

a monitor, for monitoring a landline communication medium which connects the security system with a monitoring headquarters, to determine whether the landline communication medium is active;

a switch, for switching a default communication medium from the landline communication medium to a wireless communication medium, when the landline communication medium is determined to not be active; and a transmitting unit for sending data, indicating an alarm event, over the default communication medium to the monitoring headquarters when the alarm event is detected, wherein said transmitting unit comprises a second transmitting unit for sending the data through a satellite communications link with the monitoring headquarters.

27. A security system as recited in claim 26, wherein said transmitting unit comprises an establisher for establishing a wireless communication connection with the monitoring headquarters and a second transmitting unit for sending the data through the wireless communication connection.

28. A security system as recited in claim 26, wherein said transmitting unit comprises a second transmitting unit for sending the data, indicating the alarm event, over a telephone line to the monitoring headquarters.

29. A security system as recited in claim 28, wherein said monitor comprises a detector for detecting whether the telephone line will allow for a connection to be made to a telephone network.

30. A security system as recited in claim 26, further comprising an establisher for setting the default communication medium to both the landline communication medium and the wireless communication medium, when both the landline communication medium and the wireless communication medium are active.

* * * * *